US005770552A

United States Patent [19]

Bruhnke

[11] Patent Number: 5,770,552

[45] Date of Patent: Jun. 23, 1998

[54] LAUNDRY DETERGENT COMPOSITION CONTAINING POLY(OXYALKYLENE)-SUBSTITUTED REACTIVE DYE COLORANT

[75] Inventor: John D. Bruhnke, Spartanburg, S.C.

[73] Assignee: Milliken Research Corporation, Spartanburg, S.C.

[21] Appl. No.: 815,968

[22] Filed: Mar. 13, 1997

[51] Int. Cl.[6] ..... C11D 17/00; C11D 3/00; C11D 3/40; D06D 5/13

[52] U.S. Cl. ..... 510/343; 510/276; 510/419; 510/461; 510/527; 8/403; 8/647

[58] Field of Search ..... 8/403, 647; 510/276, 510/419, 527, 531, 532, 343

[56] References Cited

U.S. PATENT DOCUMENTS

| | | | |
|---|---|---|---|
| 3,157,633 | 11/1964 | Kuhn | 260/200 |
| 3,819,324 | 6/1974 | Bino | 8/164 |
| 4,133,779 | 1/1979 | Hellyer et al. | 252/547 |
| 4,167,510 | 9/1979 | Brendle | 260/174 |
| 4,196,103 | 4/1980 | Richter | 252/541 |
| 4,261,868 | 4/1981 | Hora et al. | 252/529 |
| 4,284,729 | 8/1981 | Cross et al. | 521/158 |
| 4,285,841 | 8/1981 | Barrat et al. | 252/559 |
| 4,318,818 | 3/1982 | Letton et al. | 252/174.12 |
| 4,468,255 | 8/1984 | Schwartz et al. | 106/288 |
| 4,515,705 | 5/1985 | Moeddel | 252/174.12 |
| 4,537,706 | 8/1985 | Severson, Jr. | 252/545 |
| 4,537,707 | 8/1985 | Severson, Jr. | 252/545 |
| 4,597,898 | 7/1986 | Vander Meer | 252/529 |
| 4,634,555 | 1/1987 | Baxter et al. | 540/126 |
| 4,703,113 | 10/1987 | Baxter et al. | 534/796 |
| 4,726,844 | 2/1988 | Greenwood | 106/22 |
| 4,732,570 | 3/1988 | Baumgartner et al. | 8/506 |
| 4,738,721 | 4/1988 | Baxter et al. | 106/22 |
| 4,777,248 | 10/1988 | Greenwood | 534/803 |
| 4,810,409 | 3/1989 | Harrison et al. | 252/102 |
| 4,871,371 | 10/1989 | Harris | 8/403 |
| 4,968,451 | 11/1990 | Scheibel et al. | 252/549 |
| 5,147,576 | 9/1992 | Montague et al. | 252/174 |
| 5,176,745 | 1/1993 | Moore et al. | 106/22 |
| 5,240,464 | 8/1993 | Kluger et al. | 8/506 |
| 5,240,980 | 8/1993 | Danielson et al. | 524/190 |
| 5,250,708 | 10/1993 | Barry, Jr. | 549/226 |
| 5,259,994 | 11/1993 | Welch et al. | 252/542 |
| 5,270,363 | 12/1993 | Kluger et al. | 524/90 |
| 5,271,868 | 12/1993 | Azechi et al. | 252/358 |
| 5,288,431 | 2/1994 | Huber et al. | 252/548 |
| 5,288,746 | 2/1994 | Pramod | 252/95 |
| 5,300,250 | 4/1994 | Morgan et al. | 252/135 |
| 5,300,667 | 4/1994 | Kasprzak et al. | 556/437 |
| 5,331,100 | 7/1994 | Smith et al. | 564/468 |
| 5,338,476 | 8/1994 | Pancheri et al. | 252/174.14 |
| 5,338,491 | 8/1994 | Connor et al. | 252/548 |
| 5,354,491 | 10/1994 | Bjorkquist et al. | 252/135 |
| 5,364,550 | 11/1994 | Manzo et al. | 252/102 |
| 5,376,301 | 12/1994 | Fleuren et al. | 252/174.15 |
| 5,385,681 | 1/1995 | Sato et al. | 252/8.7 |
| 5,385,685 | 1/1995 | Humphreys et al. | 252/174.17 |

FOREIGN PATENT DOCUMENTS

| | | | |
|---|---|---|---|
| 0 176 195 | 8/1985 | European Pat. Off. | C09B 29/30 |
| 0 187 520 | 12/1985 | European Pat. Off. | C09B 43/16 |

OTHER PUBLICATIONS

Sela et al., "Newly designed polysiloxane–graft–poly(oxyethylene) copolymeric surfactants: preparation, surface activity and emulsification properties," Colloid Polym Sci 272:684–691 (1994).

Ni et al., "Synthesis of a Novel Polysiloxane–based Polymer Electrolyte and its Ionic Conductivity," Polymers for Advanced Technologies, vol. 4, pp. 80–84 (1993).

*Primary Examiner*—Paul Lieberman
*Assistant Examiner*—John M. Petruncio
*Attorney, Agent, or Firm*—Terry T. Moyer; William S. Parks

[57] ABSTRACT

The present invention relates to a laundry detergent composition, e.g, granular or liquid, comprising:

a) from 5 to 70% of tensoactive, or mixtures thereof, b) from 2 to 95% builders;

c) from 0 to 25% additives; and d) from 1 to 5000 ppm of a poly(oxyalkylene)-substituted colorant which is liquid in its undiluted state having the structure ABXYZ, where AB is a reactive dye moiety wherein A is an organic chromophore;

B is an electrophilic reactive group covalently bonded to A directly or through a linking group;

X is a nucleophilic linking group covalently bonding B and Y, selected from the group consisting of NR, O, S, and 4-oxyanilino (—HN—Ph—O—); where R is selected from the group consisting of H, alkyl, aryl, and YZ;

Y is a poly(oxyalkylene)-containing moiety; and

Z is a terminal group for Y.

17 Claims, No Drawings

LAUNDRY DETERGENT COMPOSITION CONTAINING POLY(OXYALKYLENE)-SUBSTITUTED REACTIVE DYE COLORANT

BACKGROUND OF THE INVENTION

This invention is directed to a laundry detergent composition containing a detergent component and a poly (oxyalkylene)-substituted colorant, and the use of such compositions for laundering fabrics in an aqueous wash. More particularly, this invention relates to a laundry detergent composition comprising a colorant made from a reactive dye having an electrophilic reactive group reacted with a poly(oxyalkylene)-containing moiety having a nucleophilic reactive group.

Colored detergents are manufactured commercially in large quantities for aesthetic reasons and brand identity. Although white detergent particles and clear detergent solutions have long been commercially accepted, the modern consumer often prefers attractively colored detergent products.

Generally, the small proportion of colorant in the ultimate detergent solution is insufficient to color materials being washed and dye stains are not a serious problem. However, certain materials may be discolored during washing or take on a colored cast after repeated washings with the same detergent product and contacts with the colorants contained therein. Especially in those instances wherein concentrated solutions or pastes of colored detergents are applied to fibrous materials, such as textiles, laundry, animal, vegetable and synthetic fibers or human hair, objectionable coloring can result. Among the most readily stained materials are wool, silk, nylons, rayons, polyesters, acrylics and acetates.

Organic chromogens containing poly(oxyalkylene) substituents are disclosed in Kuhn, U.S. Pat. No. 3,517,633, Brendle, U.S. Pat. No. 4,167,510, Cross et al., U.S. Pat. No. 4,284,729, Baumgartner et al., U.S. Pat. No. 4,732,570, Moore et al., U.S. Pat. No. 5,176,745, Kluger et al., U.S. Pat. No. 5,240,464, and Barry, U.S. Pat. No. 5,250,708. Poly (oxyalkylene) substituted colorants made by modifying pigment are disclosed in Schwartz et al., U.S. Pat. No. 4,468,255.

Several patents and published applications assigned to ICI relate to poly(alkylene oxide)-substituted reactive dyes, for example, Baxter et al, U.S. Pat. No. 4,634,555; Baxter et al, U.S. Pat. No. 4,703,113; Greenwood et al, U.S. Pat. No. 4,726,844; Baxter et al, U.S. Pat. No. 4,738,721; Greenwood, U.S. Pat. No. 4,777,248; EP-A 0176195 to Baxter et al.; EP-A 0187520 to Greenwood (ICI).

The relatively low molecular weights of the poly (oxyalkylenes) required by the ICI art result in dyes which exhibit a high stain factor for many substrates. Moreover, the resulting dyes are solids which must be dissolved in a suitable solvent for most uses.

Polydimethylsiloxanes prepared as copolymers with alkylene oxides are widely used as surfactants. Altering the amounts of alkylene oxide (hydrophile) and dimethylsiloxane (lipophile) affects surfactant properties. The higher the alkylene oxide content the higher the hydrophilicity. Materials with ethylene oxide contents 75% and higher are freely soluble in water and low molecular weight copolymers can be used as wetting agents, anti-foggers, anti-foamants, and slip agents in inks.

Efforts have been made to discover detergent compositions and dyes for coloring them which, even when subjected to adverse conditions, as when applied in concentrated form to a normally reactive substrate, will not result in objectionable coloration of the substrate, for example, Richter, U.S. Pat. No. 4,196,103. The present detergent compositions, colored with the colorants of the present invention, allow for the manufacture of attractively colored detergents and generally do not stain fibrous materials washed with them. Colorants employed in detergent compositions are preferably those which are easily removed from fabric if dye staining occurs, and therefore reduce fabric staining for commonplace fabrics such as cotton and polyester. Colorants of high color stability in laundry detergent compositions which exhibit minimal complexation or reaction with other laundry detergent ingredients and the laundered fabrics themselves and which are high pH stable are of particular interest. It is advantageous that they also provide high color loading and bright coloration.

For liquid laundry detergent compositions, it is desirable to provide colorants which are non-toxic, color stable, non-staining, and capable of high color loading and bright coloration without precipitating out of the composition.

SUMMARY OF THE INVENTION

The present invention relates to a laundry detergent composition comprising a tensoactive, builder, additive and a colorant, wherein the colorant is the reaction product of a reactive dye and a poly(oxyalkylene)-containing polymer having a nucleophilic reactive group. The poly(oxyalkylene) -containing polymer is preferably comprised of 3 to 100 alkylene oxide residues selected from the group consisting of ethylene oxide and propylene oxide.

The present invention also relates to a laundry detergent composition comprising:

1) from 5 to 70% of tensoactive, or mixtures thereof;
2) from 2 to 95% builders;
3) from 0 to 25% additives; and
4) from 1 to 5000 ppm of a poly(oxyalkylene)-substituted colorant having the structure ABXYZ, where
   A is an organic chromophore;
   B is an electrophilic reactive group covalently bonded to A directly or through a linking group;
   X is a nucleophilic linking group covalently bonding B and Y, selected from the group consisting of NR, O, S, and 4-oxyanilino (—HN—Ph—O—); where R is selected from the group consisting of H, alkyl, aryl, and YZ;
   Y is a poly(oxyalkylene)-containing moiety; and
   Z is a terminal group for Y.

DETAILED DESCRIPTION OF THE INVENTION

Without limiting the scope of the invention, the preferred embodiments and features are hereinafter set forth. Unless otherwise indicated, all parts and percentages are by weight and conditions are ambient, i.e. one atmosphere of pressure and 25° C. Unless otherwise specified, aliphatic hydrocarbons are from 1–12 carbon atoms in length.

All of the U.S. patents disclosed in this specification are incorporated herein by reference in their entirety.

Formulations of suitable laundry detergent compositions of the present invention include both granular detergent compositions and liquid detergent compositions.

Granular Laundry Detergents

Granular laundry detergent compositions of the present invention comprise:

1) from 5 to 70%, preferably 10 to 50%, of tensoactive, or mixtures thereof;

2) from 5 to 95%, preferably 25 to 75% builders;

3) from 0 to 25%, preferably 0 to 15% process aids/additives; and 4) from 1 to 5000 ppm, preferably 10 to 1000 ppm of a poly(oxyalkylene)-substituted colorant having the structure ABXYZ, as described above.

Tensoactives which improve the ability to clean or remove soil by reducing water surface tension include anionic surfactants, nonionic surfactants, cationic surfactants, zwitterionic surfactants, amphoterics, and soaps.

Examples of suitable anionic surfactants include linear alkylbenzene sulfonates, ethoxylated alcohol sulfates, alcohol sulfates, alkylbenzene sulfonates (branched), alkyl glyceryl ether sulfonates, alpha-sulfonated fatty acid esters, 2-acyloxyalkane-1-sulfonates, olefin and paraffin sulfonates, and beta-alkyloxyalkane sulfonates. Suitable nonionic surfactants include ethoxylated alcohols, polyglucosides, ethoxylated alkyl phenols, amine oxides, phosphine oxides, sulfoxides, and fatty acid amides. Suitable cationic surfactants include quaternary ammonium salts, amines, and amine oxides. Zwitterionic surfactants include derivatives of quaternary amonium, phosphonium, and sulfonium compounds. Suitable amphoterics include derivatives of aliphatic heterocyclic secondary and tertiary amines. Suitable soaps are those made from oils and fats (tallow, coconut oil, babasu oil, palm oil, kernal oil, rosin, and other vegetable oils).

Builders, which make the tensoactive components more efficient, are added to help control water hardness, by tying up metal ions, e.g., $Ca^{2+}$, $Mg^{2+}$, which interfere with tensoactive function. Builders also assist in soil anti-redeposition and suspension. Suitable builders include sodium and potassium tripolyphosphate, sodium and potassium pyrophosphate, sodium nitrilotriacetate, sodium citrate, citric acid, sodium carbonate, zeolites, silicates, and polymers, e.g., carboxymethylcellulose (CMC), polyvinylalcohol (PVA), polyvinylpyrrolidone (PVP), polyacrylates, and polycarboxylates.

Process aids and additives assist in the processing of the product or help bring about a special function of the product. Such materials are well known in the art and include bleaches and bleach activators, suds booster or suds suppressors, anti-tarnish and anti-corrosion agents, soil suspending/release agents, anti-redeposition agents, germnicides, fungicides, pH adjusting agents, enzymes and enzyme-stabilizing agents, smectite clays, and other fillers/builders, chlorine scavengers, perfumes, and colorants.

Examples of granular laundry detergents (except for the colorant) suitable for use in the present invention are disclosed in U.S. Pat. No. 4,196,103 to Richter, U.S. Pat. No. 5,259,994 to Welch, et al., U.S. Pat. No. 5,300,250 to Morgan, et al., U.S. Pat. No. 5,338,476 to Pancheri, et al., and U.S. Pat. No. 5,338,491 to Connor, et al.

Liquid Laundry Detergents

The liquid laundry detergent compositions of the present invention can comprise water, detergent (tensoactive), builder, process aids and special ingredients, anti-redisposition agents, bleaching ingredients, e.g., non-chlorine bleach, enzymes, optical brighteners, perfumes, and colorants. Tensoactives and builders are the same as specified above for granulated laundry detergents. Process aids and special ingredients which assist in the processing of the product or help bring about a special function of the product include fluid aids such as silica, aromatic salts, and polyacrylates; solubilizing aids, e.g., aromatic salts such as cumene sulfonate, xylene sulfonate, and toluene sulfonate, and stabilizers (used in conjunction with enzyme systems, e.g., boric acid, borax, and formate). Anti-redeposition agents which inhibit the redeposition of soil include carboxymethylcellulose (CMC), polyvinyl alcohol (PVA), and polyvinyl pyrrolidone (PVP). Bleaches added for their whitening effect include non-chlorine bleach including sodium perborate, sodium percarbonate, and activators such as tetraacetylenediamine (TAED), nonanoxylbenzene sulfonate (SNOBS), and sodium nonanoylglycolphenol sulfonate (NOGPS). Enzymes can be added to aid in removal of protein stains, corn derivative stains, and oily soil, as well as to provide fuzz removal, aid in fabric softening and aid in color protection. Such enzymes may be proteolytic or amylolytic.

Typical formulations of liquid detergent compositions contain 10 to 80%, preferably 20 to 60% water; 10 to 50%, preferably 20 to 40% anionic surfactants; 2 to 30%, preferably 5 to 20% nonionic surfactants; and 2 to 15%, preferably 5 to 10% builders; and 0.25 to 10%, preferably 1 to 5% stabilizers. Optionally, the formulation can contain 0.5 to 3%, preferably 1 to 2% cationic surfactants, and 0.01 to 5%, preferably 0.1 to 1% enzymes.

Examples of liquid laundry detergent compositions (except for the colorant added) suitable for use in the present invention as well as their preparation are disclosed in U.S. Pat. No. 4,133,779 to Hellyer et al., U.S. Pat. No. 4,261,868 to Hora et al., U.S. Pat. No. 4,285,441 to Barrat et al., U.S. Pat. No. 4,318,818 to Letton et al., U.S. Pat. No. 4,515,705 to Moeddel, U.S. Pat. No. 4,537,706 to Severson, Jr., U.S. Pat. No. 4,537,707 to Severson, Jr., U.S. Pat. No. 4,597,898 to Vander Meer, U.S. Pat. No. 4,810,409 to Harrison et al., U.S. Pat. No. 4,968,451 to Scheibel et al., U.S. Pat. No. 5,147,576 to Montague et al., U.S. Pat. No. 5,288,431 to Huber et al., U.S. Pat. No. 5,288,746 to Pramod, U.S. Pat. No. 5,331,100 to Smith, et al., U.S. Pat. No. 5,354,491 to Bjorkquist et al., U.S. Pat. No. 5,364,550 to Manzo et al.,U.S. Pat. No. 5,385,681 to Sato et al., and U.S. Pat. No. 5,385,685 to Humphreys et al.

The laundry detergent compositions are prepared by conventional methods. The colorant may be added to the composition at any point in its preparation.

Typically, the amount of staining possibly imparted to the fabric by the detergent depends on the type of fabric, the concentration of the dye in the composition, and whether there is a direct contact of the laundry detergent with the fabric. The detergent compositions of the invention are substantially non-staining.

Poly(oxyalkylene)-Subslilulled Colorant

The colorant employed in the present invention comprises a poly(oxyalkylene) substituent. The colorant may be synthesized by the reaction of a reactive dye with the polymer through a linking group. Reactive dyes can be represented as AB and are those dyes comprising an organic chromophore component A which is covalently bonded directly or through a linking group, such as an amino-containing group, to an electrophilic functional group B capable of reacting with a nucleophile to form a covalent bond either by addition or displacement.

Organic Chromophore A

A broad range of reactive dyes has been synthesized and includes those incorporating: azo groups such as monoazo, bisazo, and polyazo including their complexes with Cr, Fe, Co, and Cu; phthalocyanine; anthraquinone; aza [18] annulene; formazan copper complex; triphenodioxazine; nitroso; nitro; diarylmethane; triarylmethane; xanthene; acridene; methine; thiazole; indamine; azine; oxazine; thiazine; quinoline; indigoid; indophenol; lactone; aminoketone; hydroxyketone; and stilbene chromophores. Preferably, the reactive dye incorporates an azo, phthalocyanine or anthraquinone chromophore group.

Electrophilic Functiional Group B

The reactive dye moieties AB contain organic chromophore A and at least one electrophilic functional group B. When multiple functional groups are provided, it is often desirable that the groups vary in reactivity, to maximize conversion. Examples of electrophilic functional groups which may be incorporated into the reactive dye include: monohalotriazine; dihalotriazine; monohalopyrimidine; dihalopyrimidine; trihalopyrimidine; dihaloquinoxaline; dihalopyridazone; dihalophthalazine; halobenzothiazole; mono-(m-carboxypyridinium)-triazine; amino epoxide; methylamino; sulfatoethyl sulfone; sulfatoethyl sulfonamide; chloroethyl sulfone; vinyl sulfone; phenylamino sulfone; acrylamide; alpha-haloacryloylamide; alpha, beta-dihalopropionyl amide; halosulfonyl pyrimidine; sulfatoethylamino sulfone; sulfatopropionamide; halosulfothiazinylamide and haloacetylamide. The halo component may be selected from fluorine, chlorine and bromine. Preferably, the reactive dye incorporates an electrophilic functional group selected from monochlorotriazine, monofluorotriazine, dichlorotriazine, sulfatoethyl sulfone, vinyl sulfone, 2,3-dichloroquinoxaline, and 2,4-difluor-5-chloropyrimidine groups.

Reactive dyes meeting the above description are commercially available, described in the Colour Index, 3rd Edition, the Society of Dyers and Colourists (1971) and in the available published literature. By way of example and not limitation, the following reactive dyes may be employed: C.I. Reactive Black 5, C.I. Reactive Blue 2, C.I. Reactive Blue 4, C.I. Reactive Blue 5, C.I. Reactive Blue 7, C.I. Reactive Blue 15, C.I. Reactive Blue 19, C.I. Reactive Blue 27, C.I. Reactive Violet 3, C.I. Reactive Violet 5, C.I. Reactive Red 2, C.I. Reactive Red 24, C.I. Reactive Orange 4, C.I. Reactive Orange 13, C.I. Reactive Orange 16, C.I. Reactive Orange 78, C.I. Reactive Yellow 3, C.I. Reactive Yellow 13, C.I. Reactive Yellow 14, C.I. Reactive Yellow 17, and C.I. Reactive Yellow 95.

Nucleophilic Linking Group X

The poly(oxyalkylene)-containing substituent Y is covalently bonded to the electrophilic group B of reactive dye AB through X, a nucleophilic linking group selected from the group consisting of NR, O, S, and 4-oxyanilino (—HN—Ph—O—); where R is selected from the group consisting of H, alkyl, and YZ. Two poly(oxyalkyene)-containing substituents may be bonded to reactive dye AB through a linking group comprising a trivalent atom, e.g., N. The number of poly(oxyalkylene) chains per chromophore may be from 1–6, preferably 1–4, most preferably 1, 2 or 3.

Poly(oxyalkylene)-Containing Substituent Y

Y can be a poly(oxyalkylene)-containing moiety comprising the formula $(C_aH_{2a}O)_m(C_bH_{2b}O)_n$ where a and b are different and from 1 to 8, preferably from 1 to 4, e.g., a is 2, b is 3, m is at least 3, preferably at least 11, e.g., where lower staining factor of the resulting colorant composition is desired; n is an integer from 0 to 15 inclusive, e.g., 0 or 1. The molecular weight of the Y moiety can be less than 4000 and can range from 130 to 4000, preferably from 480 to 4000.

Typical of such Y substituents are poly(oxyalkylene) polymers and copolymers. In this regard, polyalkylene oxides and copolymers of same which may be employed to provide the colorant of the present invention are, without limitation, polyethylene oxides, polypropylene oxides, polybutylene oxides, copolymers of polyethylene oxides, polypropylene oxides and polybutylene oxides, and other copolymers including block copolymers, in which a majority of the polymeric substituent is polyethylene oxide, polypropylene oxide and/or polybutylene oxide. While such substituents generally have an average molecular weight in the range of from 130 to 4000, say, 130 to 1400, they should not be so limited.

Polysiloxane-Poly(oxyalaylene) Copolymer

In a particular embodiment of the present invention, Y can be described as a polysiloxane-poly(oxyalkylene) copolymer which incorporates (a) a polysiloxane segment characterized by a —Si($R^1$)($R^2$)O— repeating group wherein $R^1$ and $R^2$ are each selected from the group consisting of alkyl, phenyl, vinyl, 3,3,3-trifluoropropyl, and hydrogen (preferably $R^1$ and $R^2$ are alkyl, with methyl especially preferred); and (b) a polyether segment characterized by a poly (oxyalkylene) group which may be i) in the copolymer backbone or ii) pendent from a slioxane or silane repeating group.

Y copolymers having pendent poly(oxyalkylene) groups along a polysiloxane backbone may be synthesized by incorporating siloxane groups with reactive functionalities into the backbone of the polymer. The siloxane groups may be alkoxylated, esterified or otherwise provided with a poly(oxyalkylene) functionality. Copolymers having a polysiloxane backbone and pendent poly(oxyalkylene) groups are commercially available in the Masil Silicone Surfactants product line, available from PPG Industries, Inc., Gurnee, Ill., USA. Polysiloxane-polyether copolymers are disclosed in the following patents: Azechi et al. U.S. Pat. No. 5,271,868; Kasprzak et al. U.S. Pat. No. 5,300,667; and Fleuren et al. U.S. Pat. No. 5,376,301. Another method of synthesizing polysiloxane-polyether copolymers is disclosed by Jainlong Ni et al. "Synthesis of a Novel Polysiloxane-based Polymer Electrolyte and its Ionic Conductivity," Polymers for Advanced Technologies Vol. 4, pp 80–84 (1993). Allyl polyethers are grafted onto polysiloxane to form the copolymer. Sela et al., "Newly Designed Polysiloxane-graft-poly (oxyethylene) Copolymeric Surfactants," Colloid PolymSci 272:684–691 (1994) disclose comb grafted surfactants based on a poly(methylhydrogen siloxane)/poly (dimethylsiloxane) block copolymer backbone which is sililated with a vinyl terminated poly(oxyethylene) group.

Alternatively, the polysiloxane-poly(oxyalkylene) copolymer is a block copolymer incorporating a poly (oxyalkylene) substituted silane, e.g., copolymer incorporating silane a group having the structure —Si($R^3$-poly (oxyalkylene)) ($R^4$)—, where $R^3$ is an alkylene group, preferably methylene or ethylene, and $R^4$ is H, alkyl, or phenyl, preferably methyl. Such copolymers are commercially available, for example, the dimethylsiloxane-alkylene oxide copolymers available from Petrarch Systems, Silanes and Silicones Group, Bristol, Pa., USA.

Block copolymers having a poly(oxyalkylene) segment in the backbone may be synthesized by procedures well known in the art, and are commercially available from Dow Corning, Midland, Mich., USA under the 5103 Fluid and Q2-5211 wetting agent product lines.

Y can also be described as a poly(oxyalkylene)-containing polysiloxane moiety selected from the group consisting of $(OSi(R')(R''))_i O(SiR'R'''O(C_aH_{2a}O)_m(C_bH_{2b}O)_n)_j$ and $(OSi(R')(R''))_i(R'''O(C_aH_{2a}O)_m(C_bH_{2b}O)_n)_j$ where R' and R" are each alkyl, preferably C1 to C4 alkyl, more preferably methyl, R''' is alkylene, preferably C1 to C3 alkylene, more preferably ethylene, i and j are integers selected to provide a molecular weight for Y of 300 to 10000, preferably 450 to 5000, more preferably 800 to 1400, i is at least 3, j is at least 1, a and b are different and from 1 to 8, preferably from 1 to 4, more preferably from 2 to 3, m is at least 3, preferably 5 to 15, and n is from 0 to 15, preferably 0.

The poly(oxyalkylene)-containing substituent Y has a molecular weight which can range from 300 to 10000, preferably 450 to 5000, more preferably 800 to 1400.

Further description of the polysiloxane poly(oxyalkylene) copolymers useful in the present invention may be found in the Encyclopedia of Polymer Science and Engineering, John Wiley & Sons, Vol. 15, page 234–244 (1989) and the references cited therein.

End Group Z

The end group Z of poly(oxyalkylene)-containing substituent Y is not believed to be critical insofar as the functioning of the colorant is concerned. The end group Z can be any suitable terminal group, e.g., one selected from the group consisting of hydroxyl, alkyl, e.g., $C_1$ to $C_4$ alkyl, amino, amido, alkyl ester, e.g., acetyl, phenyl ester, alkyl ether, alkyl acetal, and BA where Y has a nucleophilic end group (such as where the polysiloxane-poly(oxyalkylene) copolymer is a diamine). The end group can itself contribute to solubility characteristics of the colorant product. Examples of other suitable terminal groups are those disclosed in U.S. Pat. No. 5,270,363 to Kluger, et al, for poly(oxyalkylene) polymers. Where Z is XBA the resulting colorant has the structure ABXYXBA where X,B, and A are as described above.

Colorant Preparation

The colorant compositions used in the present invention can be readily prepared by covalently bonding reactive dye AB (as listed above) to the poly(oxyalkylene)-containing XYZ group by heating an aqueous composition of the copolymer and the dye to a temperature of at least 40° C., preferably at least 60° C. The reaction time will vary according to the temperature employed, i.e., increasing the temperature will increase the rate of reaction. For example, at 85° C., the reaction is complete in two hours. The pH of the reaction composition is maintained to avoid protonating amine if present in the reaction mixture. A molar excess of the poly(oxyalkylene)-containing group XYZ is typically employed to insure complete conversion and to minimize the presence of unreacted and unsubstituted reactive dye, which can cause undesired staining. Acid scavenger such as sodium carbonate is preferably present in the reaction mixture, say, in about equivalent amounts. The poly (oxyalkylene)-substituted colorant of the present invention formed in the reaction composition may be concentrated or diluted as desired for a particular application by evaporation or the addition of water, respectively.

Suitable examples of XYZ reactants from which the present colorant compositions can be prepared include commercially available polyoxyalkyleneamines from the JEFFAMINE® series available from Huntsman Chemical and described in Texaco Chemical Company, New Product Development brochures as the M, D, ED, DU, BuD, T, MNPA, and EDR series. These polyoxyalkylene amines contain primary amino groups attached to the terminus of a polyether backbone which can be based on either propylene oxide (PO), ethylene oxide (EO), or mixed EO/PO. The JEFFAMINE® family consists of monoamines, diamines and triamines, which are available in a variety of molecular weights, ranging from 230 to 6000. JEFFAMINE® compounds are designated by letter and number, the latter representing approximate molecular weight. JEFFAMINES® include M-Series (monoamines), D-Series (amine-terminated polypropylene glycols), ED-Series (polyether diamines based on a predominately polyethylene oxide backbone imparting water solubility), DU-Series (urea condensate of D-Series products to provide a diamine product of increased molecular weight which is amine terminated), BuD-Series (urea condensate of D-Series products to provide a urea terminated product), and T-Series (propylene oxide based triamines prepared by reacting PO with a triol initiator, followed by amination of the terminal hydroxyl groups). These amines are further described in U.S. Pat. No. 5,270,363 to Kluger et al., at columns 7 to 12.

The solubility of the colorant used in the present invention can vary by the relative hydrophilic/oleophilic character of the poly(oxyalkylene) substituent and the end group, as well as the presence or absence of ionic groups on the organic chromophore. Preferably, the present colorant compositions are soluble in polar solvent, e.g., methanol and water. In particular, the present colorant compositions are greater than: 10%, 25%, 50%, or even 90% soluble in cold water.

In the method aspect of this invention, fabrics or fibers are contacted with an effective amount, generally from 100 g to 1000 g (per 3.5 kg of fiber or fabric being washed) of the detergent herein in an aqueous bath. Preferably, the wash bath contains from 10 to 10000 ppm, more preferably from 50 to 5000 ppm, of the laundry detergent compositions herein.

The invention may be further understood by reference to the following examples, but is not intended to be unduly limited thereby.

General Reaction Conditions for Preparation of Poly (oxyethylene)-Substituted Colorant:

One equivalent of reactive dyestuff was mixed with about 5–10% molar excess of nucleophilic polymer, one equivalent of sodium carbonate (or other suitable acid scavenger), and enough water to afford mixing. The reaction mixture was then heated to 80°–100° C. for 2–4 hrs. and the resultant solution then phase separated. The concentrated polymeric colorant phase was then brought to a neutral pH and further diluted with water if desired.

Example 1

Twenty-five gm of C.I. Reactive Blue 19 (25%) were mixed with 7.2 gm of JEFFAMINE® M-715 available from Huntsman (formerly Texaco Chemical Co.), Bellaire, TX, and 1.1 gm of sodium carbonate. The mixture was heated to 85° C. for two hours. The concentrated polymeric colorant was phased from the salt phase and diluted with water.

Example 2

62.8 gm of C.I. Reactive Blue 19 (50%) were mixed with 66.2 gm of Fluid Q4-3667 (poly(oxyethylene-dimethylsiloxane)copolymer) available from Dow Corning, Midland, Mich., 3 gm of sodium carbonate, and 100 gm water. The mixture was heated to 85° C. for two hours. The concentrated polymeric colorant was then diluted with water.

Example 3

61.6 gm of C.I. Reactive Red 2 (50%) were mixed with 146.8 gm of Fluid Q4-3667 (poly(oxyethylene-dimethylsiloxane)copolymer), 5.8 gm of sodium carbonate, and 100 gm water. The mixture was heated to 85° C. for two hours. The concentrated polymeric colorant was then diluted with water.

Example 4

6.2 gm of C.I. Reactive Red 2 is mixed with 14.3 gm of JEFFAMINE® M-715 and 1.1 gm of sodium carbonate, and 25 gm water. The mixture is heated to 85° C. for two hours. The concentrated polymeric colorant is then diluted with water.

Example 5

5.9 gm of C.I. Reactive Yellow 3 were mixed with 7.2 gm of JEFFAMINE® M-1000, 1.1 gm of sodium carbonate, and 25 gm water. The mixture was heated to 85° C. for two hours. The concentrated polymeric colorant was phased from the salt phase and diluted with water.

The resulting dyes were incorporated into a granular laundry detergent and a liquid laundry detergent.

Two granular laundry detergent compositions were tested. The first contained Neodol® 25-7 available from Shell Chemical Company of Houston, TX (10.0%), sodium carbonate (68.0%), sodium silicate (3.0%), sodium sulfate (18.0%), and carboxymethyl cellulose (1.0%). The second contained Neodol® 25-7 (10.0%), sodium carbonate (34.0%), sodium silicate (3.0%), sodium sulfate (18.0%), carboxymethyl cellulose (1.0%) as well as 34.0% zeolite A. Colorant was added to the powdered detergent mixtures so that the resultant shades were consistent with commercial samples. The colorants were diluted to an Absorptivity of 1 Abs/gm·cm/L, then 0.2 to 0.8 gm were applied and mixed thoroughly. Generic HDLD (heavy duty liquid detergent) was made from the following components: Water (38.8%), Caustic solution (8.2%), Monoethanolamine (2%), Steol CS-460, 60%, available from Stepan Co. of Northfield, Ill. (30%), Neodol® 25-7 (6%), Coconut fatty acid (2%), Citric acid, anhydrous (8%), and Stepanate SXS, 40%, (xylenesulfonic acid, sodium salt) available from Stepan Co. (5%). Colorant was added to the detergent solution so that the resultant Absorbance of the solution was approximately 1 Abs/gm·cm/L.

Stain testing was carried out on the colored laundry detergent compositions by application of colored liquid laundry detergent composition or wet-cake of the colored granular laundry detergent to a damp 13-fiber test fabric, obtained from Test Fabrics Co. of Middlesex, N.J. The test fabric was then dried overnight and washed. Staining was visually rated on a scale of 0 to 5, with 0 being non-staining and 5 total staining. In the lightfastness and thermal stability tests, it was observed that as the sample heated during the test, more color would leach from the colored particles, thus giving erroneously high values. The liquid laundry detergent composition samples were also stain tested by measuring the delta E of the test fabric on a Hunter Labscan available from Hunter Corporation, Reston, Va. before staining, after staining, and after washing. The 13-fiber test fabric was immersed into the colorant solution and allowed to soak for about 15 minutes. The test fabric was then air dried at least 12 hours and then rinsed with cold tap water until no bleeding of color occurred upon standing and then allowed to air dry. % Color washed out was calculated as the ratio of the difference in delta E after staining and after washing to the delta E after staining. The results (% color washed out) are provided in the Tables below.

5 Hour Xenon Lightfastness was tested by placing the dyed detergent composition in a sealed test tube and exposing to 5 hours of xenon arc irradiation using an Atlas Weatherometer, available from Atlas Electric Devices Company, Chicago, Ill. The delta E of the test solution was measured on a Spectro-Sensor II calorimeter, available from Datacolor International, Charlotte, N.C. before coloration and before and after irradiation. % Color Retained was calculated as the ratio of the difference in delta E after irradiation and before irradiation to the delta E before irradiation.

2 Week Stability at 49° C. (120° F.) was measured by placing in an oven the dyed detergent composition in a sealed test tube and exposing to a temperature of 49° C. (120° F.) for two weeks. The delta E of the test solution was measured on the Spectro-Sensor II colorimeter before coloration and before and after heating. % Color Retained was calculated as the ratio of the difference in delta E after heating and before heating to the delta E before heating. (% Color Retained).

The laundry detergent compositions of the present invention were compared with those containing the corresponding reactive dyes (Reactive Blue 19, Reactive Red 2, and Reactive Yellow 3) as well as with conventional dyes and polymeric colorants, i.e. Acid Blue 80, Lt. Blue HP, Acid Red 1, Lt. Red RL, D&C Yellow 10, Lt. Sunbeam Yellow and Lt. Yellow LP. The results show that the colorants employed in the present invention provide similar or slightly improved lightfastness over the corresponding reactive dyes and generally equivalent or improved lightfastness over conventional detergent composition dyes.

The results of the 5 Hour Xenon Lightfastness, Fiber Staining (Cotton, Nylon, Silk) (Visual Rating 0 to 5) and Two Week Stability at 49° C. (% color retained) are set out in Table 1 for granular laundry detergent composition without zeolite, Table 2 for granular laundry detergent composition with zeolite, and Table 3 for liquid laundry detergent composition. Table 4 provides detailed results of the 13 Fiber Staining test for the liquid laundry detergent formulations.

TABLE 1

| Colorant | 5 Hr Xenon Lightfastness (% Color Retained) | Fiber Staining (Cotton, Nylon, Silk) Visual Rating, 0–5 | 2 Week Stability at 49° C. (% Color Retained) |
|---|---|---|---|
| EX. 1 REACTIVE BLUE 19 + JEFFAMINE ® M-715 | 101 | 0,0,0 | 117 |
| EX. 2 REACTIVE BLUE 19 + Fluid Q4-3667 | 107 | 0,0,0 | 121 |
| REACTIVE BLUE 19 | 118 | 0,0,0 | 123 |
| ACID BLUE 80 | 69 | — | 103 |
| LT. BLUE HP | 71 | — | 99 |
| EX. 3 | 58 | 0,0,0 | 90 |

TABLE 1-continued

| Colorant | 5 Hr Xenon Lightfastness (% Color Retained) | Fiber Staining (Cotton, Nylon, Silk) Visual Rating, 0–5 | 2 Week Stability at 49° C. (% Color Retained) |
|---|---|---|---|
| REACTIVE RED 2 + Fluid Q4-3667 | | | |
| EX. 4 | 84 | 0,0,0 | 61 |
| REACTIVE RED 2 + JEFFAMINE ® M-715 | | | |
| REACTIVE RED 2 | 81 | 0,0,0 | 119 |
| ACID RED 1 | 88 | — | 109 |
| LT. RED RL | 102 | — | 100 |
| EX. 5 | 131 | 0,0,0 | 130 |
| REACTIVE YELLOW 3 + JEFFAMINE ® M-715 | | | |
| REACTIVE YELLOW 3 | 130 | 1,0,0 | 142 |
| D & C YELLOW 10 | 36 | — | 128 |
| LT. SUNBEAM YELLOW | 81 | — | 100 |
| LT. YELLOW LP | — | — | 20 |

TABLE 2

| Colorant | 5 Hr Xenon Lightfastness (% Color Retained) | Fiber Staining (Cotton, Nylon, Silk) Visual Rating, 0–5 | 2 Week Stability at 49° C. (% Color Retained) |
|---|---|---|---|
| EX. 1 | 148 | 0,0,0 | 135 |
| REACTIVE BLUE 19 + JEFFAMINE ® M-715 | | | |
| EX. 2 | 147 | 0,0,0 | 138 |
| REACTIVE BLUE 19 + Fluid Q4-3667 | | | |
| REACTIVE BLUE 19 | 139 | 0,0,0 | 140 |
| ACID BLUE 80 | 58 | — | 103 |
| LT. BLUE HP | 55 | — | 100 |
| EX. 3 | 96 | 0,0,0 | 58 |
| REACTIVE RED 2+ Fluid Q4-3667 | | | |
| EX. 4 | 136 | 0,0,0 | 80 |
| REACTIVE RED 2 + JEFFAMINE ® M-715 | | | |
| REACTIVE RED 2 | 117 | 0,0,0 | 99 |
| ACID RED 1 | 68 | — | 114 |
| LT. RED RL | 62 | — | 102 |
| EX. 5 | 126 | 1,0,0 | 119 |
| REACTIVE YELLOW 3 + JEFFAMINE ® M-715 | | | |
| REACTIVE YELLOW 3 | 143 | 3,0,1 | 135 |
| D & C YELLOW 10 | 34 | — | — |
| LT. SUNBEAM YELLOW | 71 | — | 94 |
| LT. YELLOW LP | — | — | 61 |

TABLE 3

| Colorant | 5 Hr Xenon Lightfastness (% Color Retained) | 13 Fiber Staining (Cotton, Nylon, Silk) (% Washed Out) | 2 Week Stability at 49° C. (% Color Retained) |
|---|---|---|---|
| EX. 1 | 71 | 95, 97, 96 | 101 |
| REACTIVE BLUE 19 + JEFFAMINE ® M-715 | | | |
| EX. 2 | 66 | 95, 97, 95 | 106 |
| REACTIVE BLUE 19 + Fluid Q4-3667 | | | |

TABLE 3-continued

| Colorant | 5 Hr Xenon Lightfastness (% Color Retained) | 13 Fiber Staining (Cotton, Nylon, Silk) (% Washed Out) | 2 Week Stability at 49° C. (% Color Retained) |
|---|---|---|---|
| REACTIVE BLUE 19 | 55 | 95, 98, 95 | 102 |
| ACID BLUE 80 | 46 | 93, 95, 95 | 95 |
| LT. BLUE HP | 71 | 97, 98, 88 | 96 |
| EX. 3 REACTIVE RED 2 + Fluid Q4-3667 | 0 | 81, 97, 95 | 97 |
| EX. 4 REACTIVE RED 2 + JEFFAMINE ® M-715 | 30 | 94, 99, 96 | 88 |
| REACTIVE RED 2 | 34 | 77, 98, 91 | 84 |
| ACID RED 1 | 26 | 97, 98, 97 | 88 |
| LT. RED RL | 0 | 95, 97, 91 | 93 |
| EX. 5 REACTIVE YELLOW 3 + JEFFAMINE ® M-715 | 0 | 94, 96, 98 | 99 |
| REACTIVE YELLOW 3 | 17 | 96, 96, 96 | 87 |
| D & C YELLOW 10 | 91 | 94, 94, 94 | 100 |
| LT. SUNBEAM YELLOW | 52 | 96, 97, 97 | 86 |
| LT. YELLOW LP | 5 | 91, 92, 93 | 0 |

TABLE 4

| | (% Color Washed Out) | | | | | | |
|---|---|---|---|---|---|---|---|
| | Blue 19 | Ex. 1 | Ex. 2 | Ex. 3 | Ex. 4 | Yellow 3 | Ex. 5 |
| Acetate | 97.20 | 99.10 | 98.10 | 98.46 | 98.82 | 98.79 | 98.62 |
| SEF | 96.75 | 97.61 | 96.70 | 98.12 | 98.05 | 95.95 | 95.60 |
| Arnel ® (Bright) | 94.50 | 95.22 | 96.44 | 95.21 | 99.13 | 96.76 | 96.29 |
| Bleached Cotton | 95.43 | 95.44 | 94.99 | 93.90 | 81.16 | 96.28 | 94.31 |
| Creslan ® 61 | 95.23 | 95.45 | 95.29 | 96.49 | 95.98 | 95.91 | 94.39 |
| Dacron ® 54 | 96.77 | 97.51 | 97.90 | 97.18 | 97.18 | 97.13 | 96.73 |
| Dacron ® 64 | 95.97 | 95.68 | 94.78 | 96.10 | 95.43 | 94.43 | 94.20 |
| Nylon ® 6,6 | 97.60 | 96.97 | 97.57 | 98.92 | 96.93 | 96.34 | 95.56 |
| Orlon ® 75 | 99.22 | 98.77 | 98.82 | 98.98 | 98.44 | 99.04 | 99.28 |
| Spun Silk | 94.94 | 96.49 | 95.49 | 95.59 | 94.59 | 95.72 | 98.25 |
| Poly-propylene | 98.38 | 97.96 | 97.33 | 97.04 | 97.17 | 97.96 | 97.68 |
| Viscose ® | 96.59 | 97.54 | 96.61 | 96.58 | 96.51 | 97.47 | 95.74 |
| Wool | 96.36 | 95.16 | 94.46 | 96.62 | 96.92 | 97.71 | 92.90 |

There are of course, many alternate embodiments and modifications of the invention which are intended to be included within the scope of the following claims.

It is claimed:

1. A laundry detergent composition comprising:

a) from 5 to 70% of tensoactive, or mixtures thereof;

b) from 2 to 95% builders;

c) from 0 to 25% of at least one additive selected from the group consisting essentially of bleaches, bleach activators, suds boosters, suds suppressors, anti-tarnish agents, anti-corrosion agents, soil suspending/release agents, anti-redeposition agents, germicides, fungicides, pH adjusting agents, enzymes, enzyme stabilizing agents, smectite clays, chlorine scavengers, and perfumes; and d) from 1 ppm to 5000 ppm of a poly(oxyalkylene)-substituted colorant which is liquid in its undiluted state having the structure ABXYZ, where AB is a reactive dye moiety wherein A is an organic chromophore, and B is an electrophilic group covalently bonded to A directly or through a linking group;

X is a nucleophilic linking group covalently bonding B and Y, selected from the group consisting of NR, O, S, and 4-oxyanilino (—HN—Ph—O); where R is selected from the group consisting of H, alkyl, aryl, and YZ;

Y is a poly(oxyalkylene)-containing moiety; and

Z is a terminal group for Y.

2. The composition of claim 1 wherein

A is an organic chromophore selected from the group consisting of azo, phthalocyanine, anthraquinone, aza [18]annulene, formazan copper complex, nitroso, nitro, diarylmethane, triarylmethane, xanthene, acridene, methine, thiazole, indamine, azine, oxazine, thiazine, quinoline, indigoid, indophenol, lactone, aminoketone, hydroxyketone, and stilbene chromophores;

B is an electrophilic reactive group selected from the group consisting of monohalotriazine, dihalotriazine, monohalopyrimidine, dihalopyrimidine, trihalopyrimidine, dihaloquinoxaline, dihalopyridazone, dihalophthalazine, halobenzothiazole, amino epoxide, methylamino, sulfatoethyl sulfone, sulfatoethyl sulfonamide, chloroethyl sulfone, vinyl sulfone, phenylamino sulfone, alpha-haloacryloylamide, alpha, beta-dihalopropionyl amide, halosulfonyl pyrimidine, sulfatoethylamino sulfone, sulfatopropionamide, halosulfothiazinylamide, and haloacetylamide, covalently bonded to A directly through a linking group;

Y comprises an element selected from the group consisting of i) $(C_aH_{2a}O)m(C_bH_{2b}O)_n$ where a and b are different and from 1 to 9, m is at least 3, n is 0 to 15; and ii) poly(oxyalkylene)-containing polysiloxane; and Z is a terminal group of Y, selected from the group consisting of hydroxyl, alkyl, amino, amido, alkyl ester, phenyl ester, alkyl ether, alkyl acetal, and BA where Y has a nucleophilic end group.

3. The composition of claim 2 wherein said poly (oxyalkylene)-containing polysiloxane is a polysiloxane-poly(oxyalkylene) copolymer having a backbone and a molecular weight of 300 to 10000 which comprises:

(a) a polysiloxane segment characterized by a —Si($R^1$)($R^2$)O— repeating group wherein $R^1$ and $R^2$ are each selected from the group consisting of alkyl, phenyl, vinyl, 3,3,3-trifluoropropyl, and hydrogen; and (b) a polyether segment characterized by a poly (oxyalkylene) group which is i) in the copolymer backbone or ii) pendent from a siloxane or silane repeating group, said poly(oxyalkylene) group comprising 5 to 95 % of Y.

4. The composition of claim 3 wherein Y comprises a poly(oxyalkylene)-containing polysiloxane moiety formula selected from the group consisting of $(OSi(R')(R''))_iO(SiR'R'''O(C_aH_{2a}O)_m(C_bH_{2b}O)_n)_j$ and $(OSi(R')(R''))_i(R'''O(C_aH_{2a}O)_m(C_bH_{2b}O)_n)_j$ where R' and R" are each alkyl, R'" is alkylene, i and j are integers selected to provide a molecular weight for Y of 300 to 10000, i is at least 3, j is at least 1, a and b are different and from 1 to 8, m is at least 3, and n is from 0 to 15.

5. The composition of claim 2 wherein

A is selected from the group consisting of azo, phthalocyanine and anthraquinone chromophores;

B is selected from the group consisting of monochlorotriazine, dichlorotriazine, monofluorotriazine, sulfatoethylsulfone, vinyl sulfone, 2,3-dichloroquinoxaline and 2,4-difluor-5-chloropyrimidine;

X is NR where R is selected from the group consisting of H, alkyl, aryl, and YZ; and Z is a terminal group for Y, selected from the group consisting of OH, $C_1$ to $C_4$ alkyl, acetyl, amino, and amido.

6. The composition of claim 5 wherein

A is anthraquinone;

Y is a poly(oxyalkylene)-containing moiety comprising the formula $(C_aH_{2a}O)_m(C_bH_{2b}O)_n$ where a is 2, b is 3; and Z is selected from the group consisting of OH and amino.

7. The composition of claim 4 wherein R' and R" are each methyl, a is 2, b is 3, and n is at least 1.

8. The composition of claim 4 wherein R' and R" are each methyl, a is 2, and n is 0.

9. The composition of claim 4 wherein R' and R" are each methyl, a is 3, and n is 0.

10. The composition of claim 2 wherein AB is selected from the group consisting of C.I. Reactive Black 5, C.I. Reactive Blue 2, C.I. Reactive Blue 4, C.I. Reactive Blue 5, C.I. Reactive Blue 7, C.I. Reactive Blue 15, C.I. Reactive Blue 19, C. I. Reactive Blue 27, C.I. Reactive Violet 3, C.I. Reactive Violet 5, C.I. Reactive Red 2, C.I. Reactive Red 24, C.I. Reactive Orange 4, C.I. Reactive Orange 13, C.I. Reactive Orange 16, C.I. Reactive Orange 78, C.I. Reactive Yellow 3, C.I. Reactive Yellow 13, C.I. Reactive Yellow 14, C. I. Reactive Yellow 17, and C.I. Reactive Yellow 95; and Y has a molecular weight ranging from 300 to 10,000.

11. The composition of claim 2 wherein AB is selected from the group consisting of C.I. Reactive Blue 2, C.I. Reactive Blue 4, C.I. Reactive Blue 5, C.I. Reactive Blue 7, C.I. Reactive Blue 15, C.I. Reactive Blue 19, C.I. Reactive Blue 27, and wherein Y has a molecular weight ranging from 450 to 5,000.

12. The composition of claim 2 wherein AB is selected from the group consisting of C.I. Reactive Blue 19, C.I. Reactive Red 2, and C.I. Reactive Yellow 3.

13. A granular laundry detergent which comprises:

a) from 5 to 70% of tensoactive, or mixtures thereof;

b) from 2 to 95% builders;

c) from 0 to 25% of at least one additive selected from the oroup consisting essentially of bleaches, bleach activators, suds boosters, suds suppressors, anti-tarnish agents, anti-corrosion agents, soil suspending/release agents, anti-redeposition agents, germicides, fungicides, pH adjusting agents, enzymes, enzyme stabilizing agents, smectite clays, chlorine scavengers, perfumes, and zeolites; and d) from 1 ppm to 5000 ppm of a poly(oxyalkylene)-substituted colorant which is liquid in its undiluted state having the structure ABXYZ, where AB is a reactive dye moiety wherein A is an organic chromophore, and B is an electrophilic group covalently bonded to A directly or through a linking group;

X is a nucleophilic linking group covalently bonding B and Y, selected from the group consisting of NR, O, S, and 4-oxyanilino (—HN—Ph—O); where R is selected from the group consisting of H, alkyl, aryl, and YZ;

Y is a poly(oxyalkylene)-containing moiety; and

Z is a terminal group for Y.

14. The composition of claim 13 which comprises a zeolite additive.

15. The composition of claim 13 wherein

A is an organic chromophore selected from the group consisting of azo, phthalocyanine, anthraquinone, aza annulene, fornazan copper complex, nitroso, nitro, diarylmethane, triarylmethane, xanthene, acridene, methine, thiazole, indamine, azine, oxazine, thiazine, quinoline indigoid, indophenol, lactone, aminoketone, hydroxyketone, and stilbene chromophores;

B is an electrophilic reactive group selected from the group consisting of monohalotriazine, dihalotriazine, monohalopyrimidine, dihalopyrimidine, trihalopyrimidine, dihaloquinoxaline, dihalopyridazone, dihalophthalazine, halobenzotiazole, amino epoxide, methylamino, sulfatoeothyl sulfone, sulfatoethyl sulfonamide, chloroethyl sulfone, vinyl sulfone, phenylamino sulfone, alpha-haloacryloylamide, alpha, beta-dihalopropionyl amide, halosulfonyl pyrimidine, sulfatoethylamino sulfone, sulfatopropionamide, halosulfothiazinylamide, and haloacetylamide, covalently bonded to A directly through a linking group;

Y comprises an element selected from the group consisting of i) $(C_aH_{2a}O)m(C_bH_{2b}O)_n$ where a and b are different and from 1 to 9, m is at least 3, n is 0 to 15; and ii) poly(oxyalkylene)-containing polysiloxane; and Z is a terminal group of Y, selected from the group consisting of hydroxyl, alkyl, amino, amido, alkyl ester, phenyl ester, alkyl ether, alkyl acetal, and BA where Y has a nucleophilic end group.

16. The composition of claim 13 wherein

A is selected from the group consisting of azo, phthalocyanine and anthraquinone chromophores;

B is selected from the group consisting of monochlorotriazine, dichlorotriazine, monofluorotriazine, sulfatoethyl sulfone, vinyl sulfone, 2,3-dichloroquinoxaline and 2,4-difluor-5-chloropyrimidine;

X is NR where R is selected from the group consisting of H, alkyl, aryl, and YZ; and Z is a terminal group for Y, selected from the group consisting of OH, $C_1$ to $C_4$ alkyl, acetyl, amino, and amido.

17. A liquid laundry detergent composition comprising:

a) from 10 to 80% water;

b) from 10 to 50% anionic surfactants;

c) from 2 to 30% nonionic surfactants;

d) from 2 to 15% builders;

e) from 0.25 to 10% stabilizers; and f) from 1 ppm to 5000 ppm of a poly(oxyalkylene)-substituted colorant which is liquid in its undiluted state having the structure ABXYZ, where AB is a reactive dye moiety wherein A is an organic chromophore, and B is an electrophilic group covalently bonded to A directly or through a linking group;

X is a nucleophilic linking group covalently bonding B and Y, selected from the group consisting of NR, O, S, and 4-oxyanilino (—HN—Ph—O); where R is selected from the group consisting of H, alkyl, aryl, and YZ;

Y is a poly(oxyalkylene)-containing moiety; and

Z is a terminal group for Y.

* * * * *